US006505820B2

(12) United States Patent
Sicking et al.

(10) Patent No.: US 6,505,820 B2
(45) **Date of Patent: *Jan. 14, 2003**

(54) GUARDRAIL TERMINAL

(75) Inventors: Dean L. Sicking; Brian G. Pfeifer, both of Lincoln, NE (US)

(73) Assignee: Kothmann Enterprises, Inc., Big Spring, TX (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/410,635

(22) Filed: Oct. 1, 1999

(65) Prior Publication Data

US 2001/0013596 A1 Aug. 16, 2001

Related U.S. Application Data

(62) Division of application No. 08/335,153, filed on Nov. 7, 1994, now Pat. No. 6,022,003.

(51) Int. Cl.[7] ..... A01K 3/00

(52) U.S. Cl. ..... 256/13.1; 256/17; 256/59; 404/6; 404/9; 404/10

(58) Field of Search ..... 256/13.1; 404/6, 404/9, 10; 403/2, 279, 284

(56) References Cited

U.S. PATENT DOCUMENTS

| | | | | |
|---|---|---|---|---|
| 3,428,150 A | | 2/1969 | Muspratt | |
| 3,587,787 A | | 6/1971 | Rich et al. | |
| 3,596,963 A | * | 8/1971 | Phillips | 293/76 |
| 3,600,003 A | | 8/1971 | Carey | 280/150 AB |
| 3,749,205 A | | 7/1973 | Fletcher et al. | |
| 3,779,591 A | | 12/1973 | Rands | 293/89 |
| 3,782,505 A | | 1/1974 | Armstrong | 188/1 C |
| 3,819,218 A | | 6/1974 | Liu | |
| 3,853,298 A | | 12/1974 | Libkie et al. | 248/429 |
| 3,865,418 A | | 2/1975 | Saxl | |
| 3,893,726 A | | 7/1975 | Strohschein | 293/1 |
| 3,997,133 A | | 12/1976 | Fagan | 244/104 R |
| 4,273,361 A | | 6/1981 | Takei et al. | 280/805 |
| 4,346,795 A | | 8/1982 | Herbert | 188/375 |
| 4,352,484 A | | 10/1982 | Gertz et al. | |
| 4,655,434 A | * | 4/1987 | Bronstad | 256/13.1 |
| 4,666,130 A | | 5/1987 | Denman et al. | |
| 4,823,923 A | | 4/1989 | Moyer | |
| 4,928,928 A | * | 5/1990 | Buth et al. | 256/13.1 |
| 5,022,782 A | * | 6/1991 | Gertz et al. | 404/6 |
| 5,078,366 A | * | 1/1992 | Sicking et al. | 256/13.1 |
| 5,090,755 A | | 2/1992 | Garnweidner | 293/133 |
| 5,096,242 A | | 3/1992 | Chin-Hun | 293/5 |
| 5,217,318 A | | 6/1993 | Peppel | |
| 5,222,915 A | | 6/1993 | Petrzelka | 464/181 |
| 5,238,228 A | * | 8/1993 | Moon | 256/13.1 |
| 5,391,016 A | * | 2/1995 | Ivey et al. | 404/6 |
| 5,403,113 A | * | 4/1995 | Gertz et al. | 404/6 |
| 5,431,447 A | | 7/1995 | Bauer | 280/805 |
| 5,765,811 A | * | 6/1998 | Alberson et al. | 256/13.1 |
| 5,775,675 A | * | 7/1998 | Sicking et al. | 256/13.1 |
| 5,791,812 A | * | 8/1998 | Ivey | 256/13.1 X |
| 5,797,591 A | * | 8/1998 | Krage | 256/13.1 |
| 5,851,005 A | * | 12/1998 | Muller et al. | 256/13.1 |
| 5,924,680 A | * | 7/1999 | Sicking et al. | 256/13.1 |
| 5,957,435 A | * | 9/1999 | Bronstad | 256/13.1 |
| 5,988,598 A | * | 11/1999 | Sicking et al. | 256/13.1 |

* cited by examiner

*Primary Examiner*—Bruce A. Lev
(74) *Attorney, Agent, or Firm*—Winstead Sechrest & Minick P.C.; Henry L. Ehrlich

(57) ABSTRACT

To reduce the danger of bodily harm to occupants of vehicles that leave the roadway, a guardrail system includes a guardrail terminal and a guardrail. The guardrail terminal includes cutting members positioned to cut said guardrail as guardrail moves within said guardrail terminal and the guardrail terminal moves with respect to the guardrail to cut the guardrail when impacted by a vehicle.

18 Claims, 6 Drawing Sheets

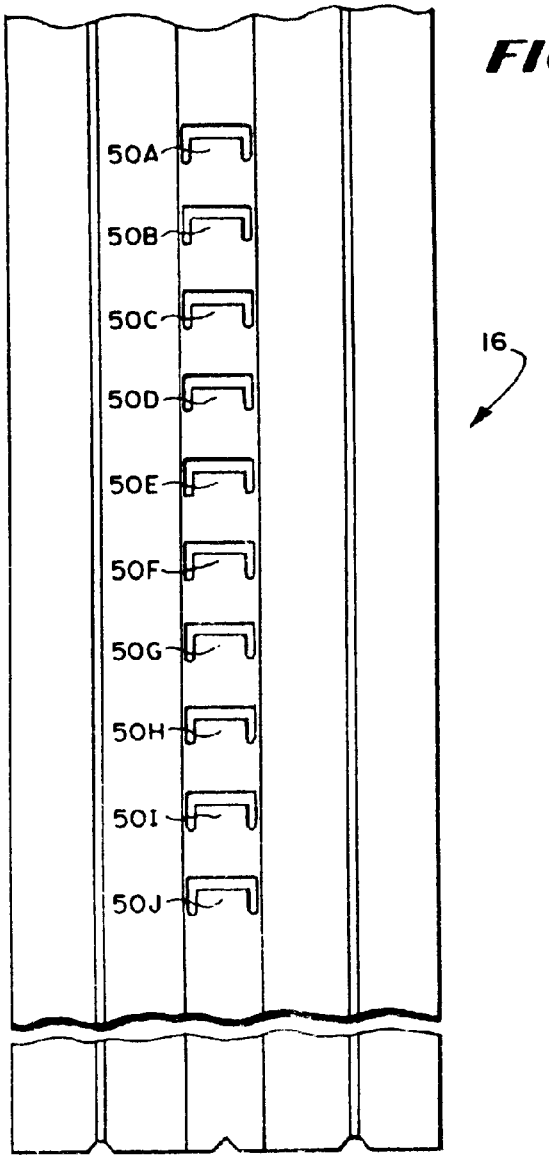
FIG. 13
FIG. 14
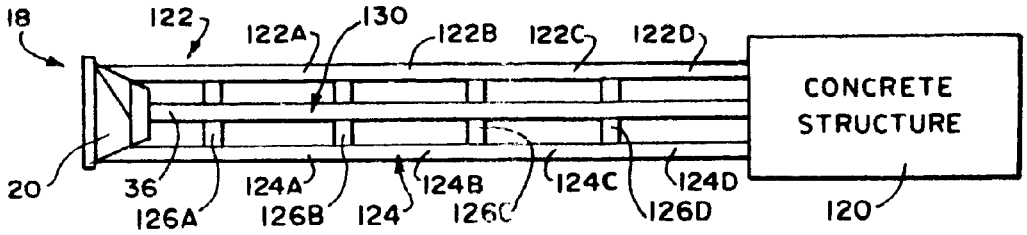

GUARDRAIL TERMINAL

REFERENCE TO RELATED APPLICATIONS

This application is a divisional application of U.S. application Ser. No. 08/335,153, filed Nov. 7, 1994, for a Guardrail Cutting Terminals, now U.S. Pat. No. 6,002,003.

BACKGROUND OF THE INVENTION

This invention relates to guardrails intended to be positioned along a highway to reduce injury to the driver and passenger of vehicles that may accidentally tend to leave the highway.

In one class of guardrail system, each guardrail system includes an elongated barrier and at least one energy-absorbing terminal. The elongated barrier extends parallel to the roadway along the side of the roadway and ends in a terminal. The terminal cooperates with one or more components of the barrier to absorb energy when a vehicle hits the terminal itself.

The terminal is constructed to stop the vehicle without subjecting the occupant to excessive forces and to avoid impaling the passenger compartment of the vehicle or redirecting the vehicle in a dangerous direction or permitting the vehicle to continue in a dangerous direction at a dangerous speed when the vehicle hits the terminal itself. The barrier is designed to redirect the vehicle in a safer direction and impede its progress when the vehicle hits the barrier itself.

The terminals and barrier of the energy-absorbing guardrail are designed so that: (1) when the vehicle hits the barrier itself, the barrier is anchored by a cable or similar component with tensile strength to support the vehicle from moving excessively in a direction perpendicular to the roadway; and (2) when the vehicle hits the terminal, the cable or other support member is released to avoid pulling the barrier out of its alignment with the terminal which would prevent the movement of the terminal and barrier together to absorb energy.

A prior art guardrail of this class is described in U.S. Pat. Nos. 4,928,928 and 5,078,366 filed in the name of Sicking, et al. This prior art energy-absorbing guardrail has a terminal that extrudes a metal portion of the barrier, which is generally a W-beam rail or the like. In this prior art guardrail, the terminal, upon impact by a vehicle, moves along the rail, forcing the rail into a narrowing chute to extrude the rail and bend it into a roll, thus absorbing energy from metal working the rail. When the terminal is impacted, the cable anchoring the rail is released by the force of the impact.

This type of guardrail has several disadvantages, such as for example: (1) it is relatively expensive; and (2) the basic configuration cannot be readily adapted to different thicknesses of beam or to different materials from which the barrier may be constructed. Moreover, it is difficult to adapt the basic design to absorb energy at different rates depending on the nature of the roadway along which it is positioned. Thus, the rate of absorbing energy is the same for highways adapted to carry trucks and other vehicles at high speeds as it is for roadways having a lower speed limit and being adapted for smaller vehicles traveling at lower speeds although the highway may call for much more energy absorption per linear foot of travel of the vehicle striking the terminal.

Another prior art energy-absorbing guardrail of this class is disclosed in U.S. Pat. No. 4,655,434 to Bronstad and U.S. Pat. No. 4,838,523 to Walter P. Humble, et al. This prior art guardrail includes two parallel rails with horizontal connecting members between them. The terminal, when hit by a vehicle, moves along the guardrail, hitting the horizontal connecting members as it goes and causing the connecting members to move along a line of perforations in the metal rails, absorbing energy from the metal working as it moves.

This type of guardrail has a disadvantage of being expensive and not adapted for different sizes and speeds of automobiles without special design.

SUMMARY OF THE INVENTION

It is an object of the invention to provide a novel guardrail system.

It is a further object of the invention to provide a novel energy-absorbing terminal for guardrail systems.

It is a still further object of the invention to provide a method and apparatus for absorbing the energy of a vehicle that collides with a guardrail system.

It is a still further object of the invention to provide a method and apparatus for restraining and redirecting vehicles that collide with guardrail systems.

It is a still further object of the invention to provide a method and apparatus for making and using an energy-absorbing guardrail terminal adapted for a particular type of guardrail and an energy-absorbing guardrail terminal that can be inexpensively adapted for different types of guardrails.

It is a still further object of the invention to provide a method of making guardrails adapted for a particular highway and a guardrail which can be inexpensively adapted for the different highways.

It is a still further object of the invention to provide an energy-absorbing guardrail terminal useful with beams of reinforced plastic in a guardrail.

In accordance with the above and further objects of the invention, a guardrail system includes a guardrail and a guardrail terminal arranged so that the terminal cooperates with the guardrail to absorb energy if a vehicle hits the terminal and releases the guardrail upon impact of the vehicle with the terminal but anchors the guardrail if the guardrail is impacted by the vehicle instead of the terminal.

The terminal assembly includes an impact head and a cutting section. When the impact head is hit by a vehicle, it moves the cutting section in a manner to cut the beam of the guardrail and activates an anchor release to release the anchor from the guardrail itself. In the preferred embodiment, the guardrail is released from a cable by breaking the first post which has the cable bolted to it at one end. The other end of the cable is mounted to the guardrail. The post breaks at the cable connection, releasing the cable.

The cutting section includes a tube having one or more cutting members within it and a deflection plate. The cutting member or members are designed to aid the deflection plate in the absorption of energy.

For example, one or more shear type cutters may be located to reduce the moment of inertia of beams and thereby to reduce the total amount of energy absorbed per linear foot of travel for each portion of a beam when a thicker metal guardrail beam is used and thus compensate for the increased energy absorbed because of the thickness of the guardrail and vice versa. Thus, the guardrail system may be designed to accommodate different types and thicknesses of guardrail beams. Similarly, the energy absorbed for each linear foot of travel may be tailored for the nature of the traffic on the roadway such as to absorb more energy for roadways where the traffic is faster and includes heavier vehicles and to absorb less energy per linear foot for roadways in which the traffic is slower and includes lighter vehicles.

In the case of nonmetallic beams or beams of any other type that absorb energy during fragmenting by buckling, compression failure, breaking and tensile failure against or because of the deflecting plate rather than bending, such as some fiber reinforced plastic beams, cutters aid in centering the beam portions, in causing the fragmenting to take place near the deflection plate to increase the amount of energy to be absorbed and maintaining stability of the operation. For example, the proper angle of a wedge shaped cutter and the proper location of the cutter stabilizes the path of the fragments of the plastic reinforced beams after being cut. The shape and location of the cutters and the shape and location of the deflector plates affect the amount of fragmenting and thereby increase or decrease the energy absorption per foot of travel by increasing the fragmenting or decreasing the amount of fragmenting respectively.

From the above description, it can be understood that the guardrail system of this invention has several advantages, such as: (1) it is relatively inexpensive to fabricate; and (2) it may be easily designed for different rates of energy absorption without modifying the heavy frame structure and only modifying the cutting mechanisms themselves.

SUMMARY OF THE DRAWINGS

The above noted and other features of the invention will be better understood from the following detailed description when considered with reference to the accompanying drawings, in which:

FIG. 13 is an elevational view of a W-rail adapted to receive the anchor of FIGS. 11 and 12;

FIG. 14 is a plan view of a terminal in accordance with an embodiment of the invention used as an energy-absorbing guard for objects near a roadway.

DETAILED DESCRIPTION

Figure 1:
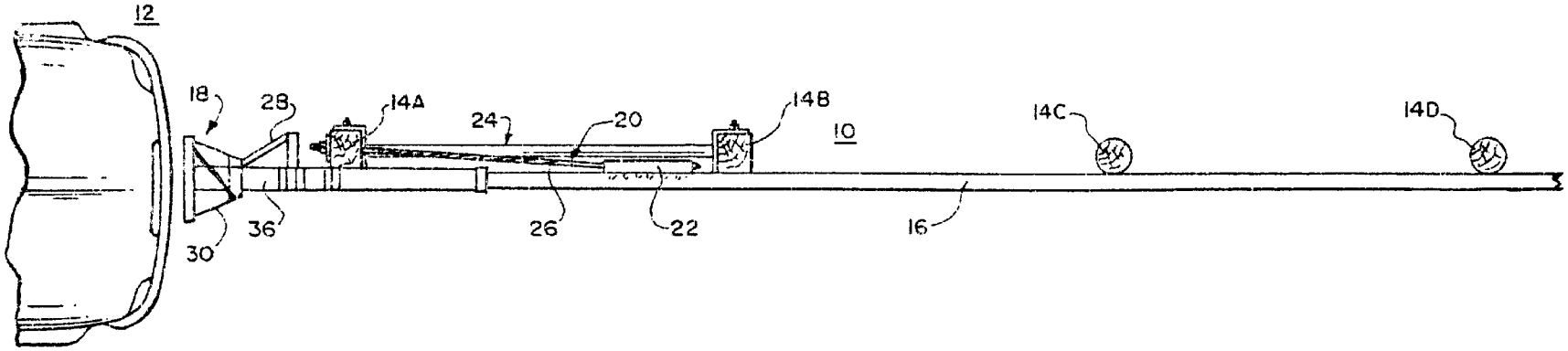
FIG. 1 is a fragmentary plan view of a guardrail system in accordance with an embodiment of the invention.

In FIG. 1, there is shown a plan view of a guardrail system 10 with a vehicle 12 positioned to hit it. The guardrail system 10 includes a plurality of posts, four of which are shown at 14A, 14B, 14C and 14D, a guardrail 16, a terminal assembly 18 and a cable anchoring system 20, with the terminal assembly 18 being at one end of the guardrail 16 and the cable anchoring system connecting the guardrail 16 to a support. The guardrail 16 is mounted to the posts 14A–14D to be substantially parallel to a roadway.

In this guardrail system, the terminal assembly 18 and the guardrail 16 cooperate together to reduce the likelihood of bodily injury to passengers and guests in the vehicle 12 when the vehicle 12 leaves the roadway and impacts against the guardrail 16 or the terminal assembly 18 at its end. The guardrail 16 may be of any suitable type, but in the preferred embodiment, it includes a conventional W-beam. Similarly, the posts 14A, 14B, 14C and 14C may be of any general type but in the preferred embodiment are wood posts which have mounted to their side facing the roadway, the guardrail 16 by bolts or indentations or the like. The terminal assembly 18 is mounted to the guardrail 16 at one end and positioned so that it may move along the guardrail, cutting the guardrail to absorb energy when it is impacted by the vehicle 12.

The terminal assembly 18 includes a post breaking arm 28, an impact head 30 and a cutting section 36. The impact head 30 is a strong wide-mouthed section having its wide portion facing outwardly from the guardrail 16 to receive a vehicle such as 12 and its narrower end connected to one end of the cutting section 36. The post breaking arm 28 is a braced metal member that extends outwardly from the longitudinal axis of the terminal and the guardrail, positioned to hit the post 14A and break it when a vehicle such as 12 pushes the impact head 30 and the cutting section 36 forwardly along the guardrail to cut the guardrail. The guardrail 16 may be severed into partly separated portions or only scored to provide partial grooves, depending on the nature of the cutting section 36.

The cable anchoring system 20 includes an anchor 22 and a cable 26. The anchor 22 has openings along its length which receive tabs formed in the guardrail 16 to be held firmly when the guardrail is impacted at an angle along its length. One end of the cable 26 passes through the anchor 22 and is held by a bolt on one side but extends from the opposite end. The other end of the cable 26 is bolted to the post 14A at its weakest point so that, when the impact head 30 moves under the force of a vehicle 12, the post breaking arm 28 breaks the post 14A at the point where the cable 26 is attached to release the anchor 22 and allow the guardrail 16 to be fed through the cutting section 36. A ground line pipe strut 24 extends between the first two posts to provide a connection that prevents the excessive movement of either post upon impact of a vehicle with the guardrail 16.

Figure 2:
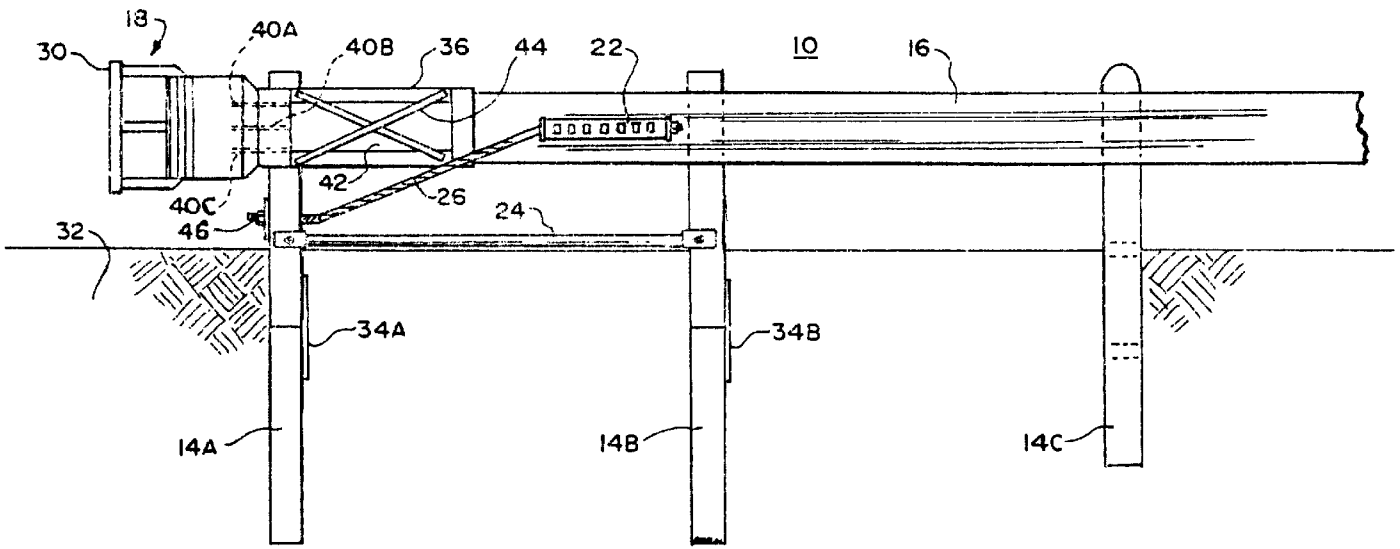
FIG. 2 is a fragmentary side elevational view of the guardrail system of FIG. 1.

In FIG. 2, there is shown a fragmentary elevational view of the guardrail system 10 from the fron side of the system or the right side of the road showing the terminal assembly 18 connected to the guardrail 16, which in turn is connected to a plurality of posts, the posts 14A–14C being shown in FIG. 2. The posts are mounted in the ground 32 and the first two posts 14A and 14B are connected to each other by the ground line pipe strut 24 to provide combined resistance to movement.

The cable 26 is connected at one end to the anchor 22 and at its other end, to the post 14A by a bolt 46 passing through the post 14A. Reinforcing members 34A and 34B and the pipe strut 24 between them maintain the posts 14A and 14B in position during impact.

When a vehicle strikes from the front side of the guardrail 16, it moves the guardrail toward the rear, but the guardrail is restrained by the cable 26 and tension to impede movement of the vehicle off the road and redirects the vehicle to some extent back onto the roadway. In this specification, the front side means the side of the guardrail system facing the road. The rear side means the side of the guardrail system facing away from the roadway. The cutting section 36 of the terminal assembly 18 includes a plurality of cutters, three of which are shown at 40A–40C mounted between the impact head 30 and the cutting section 36 and facing the guardrail 16, which may be a W-beam rail. The cutters are positioned to each engage the rail 16 and cut it in three parallel lines along its length as the terminal is moved toward the rail 16.

The cutting section 36 is open, having supports such as support 44 forming a guide that receives the W-beam as the cutting section 36 and impact head 30 are moved with respect to the W-beam 16 so that the W-beam moves into the hollow portion of the cutting section 36 and hits the cutters 40A–40C. These cutters slice the rail 16 with a shearing action in the embodiment of FIG. 2. For standard W-beams positioned along a highway, three shear type cutters as described hereinafter provide an appropriate amount of energy absorbing as the terminal and rail are moved together for cutting.

Figure 3:
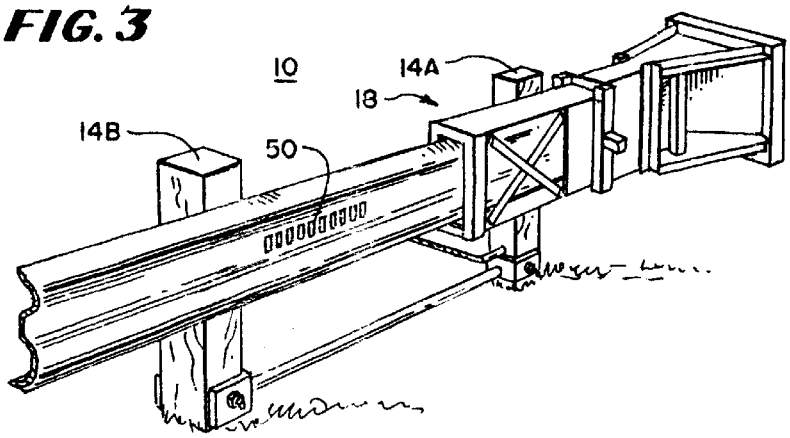
FIG. 3 is a fragmentary perspective view of a portion of a guardrail and terminal assembly showing the top and rear side of the guardrail system in accordance with an embodiment of the invention.
Figure 4:
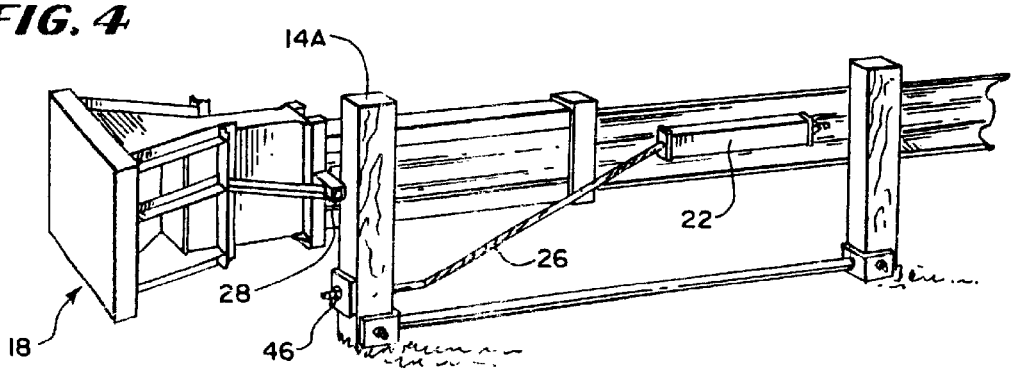
FIG. 4 is another fragmentary perspective view of the terminal and guardrail of FIG. 1 showing the top and front side of the guardrail system.

In FIG. 3, there is shown a fragmentary, perspective view of the top and rear side of the guardrail system 10 illustrating the manner in which tabs 50 from the anchor 22 (FIG. 2) extend through a W-beam of the guardrail system 10 to hold the anchor 22 in place as better shown in FIG. 4. FIG. 4 is a fragmentary, perspective view of the front side of the guardrail system 10 showing the anchor 22 holding one end of the cable 26, with the other end being fastened to the post 14A by the bolt 46. With this arrangement, when a vehicle hits the W-beam, the beam is held by the cable 26 to aid in redirecting the vehicle but when the vehicle hits the terminal 18, the post 14A is broken by the post breaking arm 28 to release the cable 26 so that the guardrail can continue to travel through the energy absorbing terminal.

Figure 5:
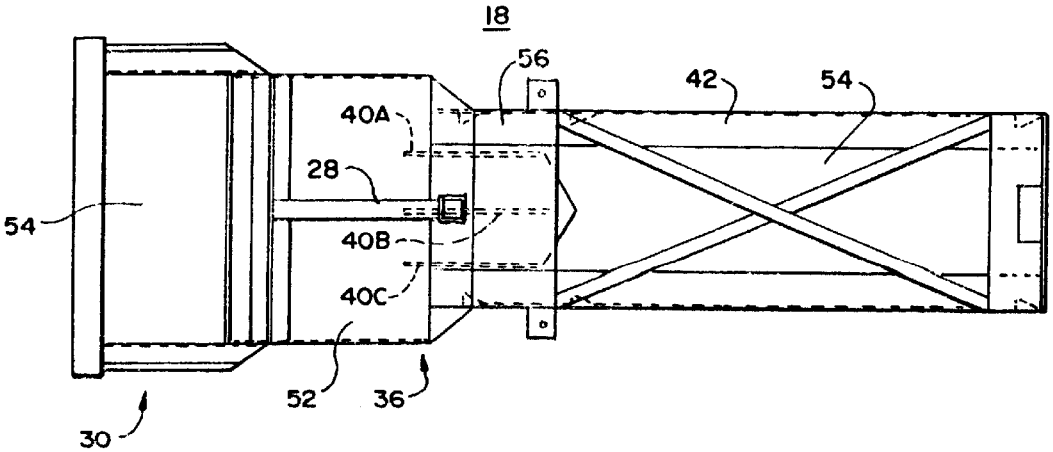
FIG. 5 is an elevational view of an impact head and cutting section of the embodiment of FIG. 1.

In FIG. 5, there is shown a side elevational view of the terminal assembly 18 having a hollow impact head 30 and a cutting section 36. The cutting section 36 includes a cutter holding section 52 and a hollow receiving section 42, each aligned with the other and fastened together so that there is a continuous passageway 54 throughout the interior of the receiving section 42, cutter holding section 52 and the interior of the impact head 30.

The impact head 30 is made of heavy steel in the preferred embodiment but may be made of other materials provided they are sufficiently strong to move the entire terminal with respect to the rail while the rail being cut within the cutting section 36. The impact head 30 is sized: (1) to engage a sufficient area of the vehicle that hits the impact head to avoid penetrating the vehicle body; and (2) to avoid any dimension that would permit the impact head 30 to project sufficiently to block the roadway.

The cutting section 36 includes a square tubular steel frame 56 having the cutters 40A–40C welded within it to be horizontal when the terminal assembly 18 is mounted in place. The cutters may be three steel blades 40A, 40B and 40C, parallel to each other and positioned to be received by the W-beam in a V-shaped notch in the vertically mounted rail to cut the rail. A deflector plate, not shown in FIG. 5, moves the rail to the side to utilize energy in bending.

The passageway 54 is a right regular parallelopiped within the receiving section 42 and is joined by bevelled edges to a larger right regular parallelopiped in the blade holding section 56 and from there, to the open section 54 so that relatively straight cuts are made in the rail without absorbing energy by squeezing or extruding the rail.

Figure 6:
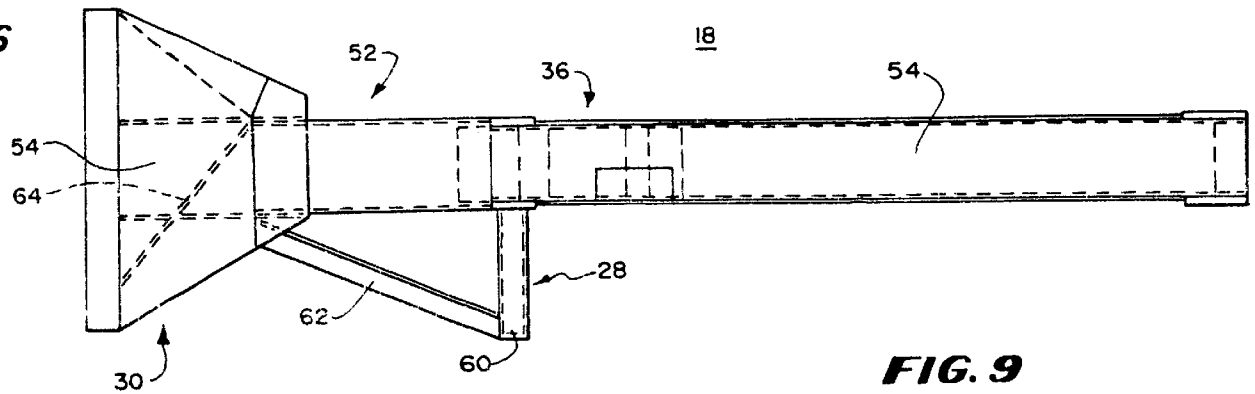
FIG. 6 is a plan view of the impact head and cutting section of FIG. 5.

In FIG. 6, there is shown a plan view of the terminal assembly 18 showing the post breaking arm 28 which is formed preferably of steel tubing having an orthogonally extending tube 60 braced by a diagonal tube 62. The orthogonal extending tube 60 is, in the preferred embodiment, a two inch by two inch by three-sixteenth inch structural tube extending outwardly approximately one foot and the diagonal bracing member 62 is one and one-half inch by one and one-half inch by three-sixteenth inch structural tube welded at one end to the distal end of the extending tube 60 and at its other end to the wall of the terminal 18 closer to the impact head 30 than the outwardly extending post 60. They are positioned to hit the post 14A (FIG. 1) at a location above the bolt and provide sufficient force to break the post.

To bend the cut portions of the guardrail, a deflector plate 64 is mounted at an angle to the longitudinal axis of the passageway 54. With this arrangement, fragments of severed portions of the guardrail beam are bent to the side, absorbing further energy.

Figure 7:
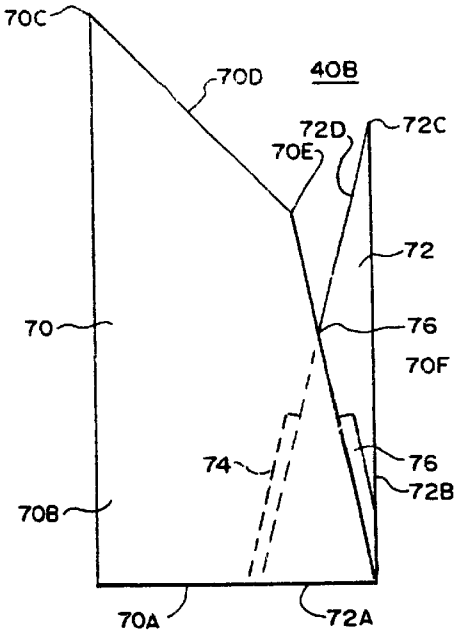
FIG. 7 is an elevational view of one form of cutter in accordance with an embodiment of the invention.

In FIG. 7, there is shown an elevational view of the cutter 40B formed by first and second steel sections 70 and 72 welded together at locations 74 and 76. The first and second steel sections 70 and 72 are each abrasion resistant steel plates dimensioned to be stronger than the W-beam so as to be able to sever it.

The first steel plate 70 has a base edge 70A, which in the preferred embodiment is approximately four and seven-eighth inches long, an upwardly extending side edge 70B which is approximately eight inches high and ends in a point 70C, the side edge 70B forming a right angle with the base edge 70A. A side edge 70D slants downwardly from the peak 70C to a point 70E and then at an angle slants downwardly more steeply along a edge 70F to the other side of the base edge 70A.

The second steel plate 72 has a base edge 72A which ends at the bottom end of the edge 70E for the first plate 70 and extends perpendicularly upwardly along an edge 72B to a point 72C lower than the point 70C. From the point 72C, an edge 72D of the second plate 72 extends downwardly to the base 72A at a sharp angle so that it is spaced from the edge 70E until approximately one-third of the distance to the base 72A. Where the edges 72D and 70E cross at a point 76, an acute angle is formed. The welds 74 and 76 are closer to the bases 70A and 72A to hold the plates together.

The location of the point 76 is positioned to engage the W-beam 16 (FIGS. 1 and 2) when a vehicle such as 12 engages the impact head 30 (FIG. 1) to cut the W-beam 16 at three locations. The cutters 40A, 40B and 40C (FIG. 5) are substantially the same and in FIG. 8, bear the same reference numerals. The cutter blades in the preferred embodiment are three-eighths inch in thickness.

Figure 8:
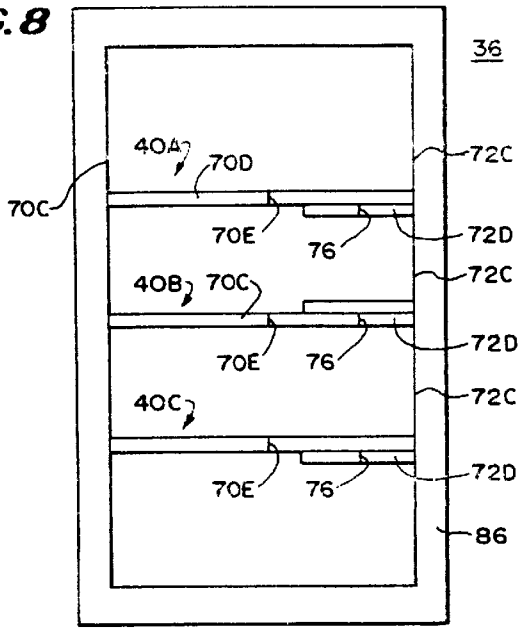
FIG. 8 is a fragmentary end view of a cutting section in accordance with the embodiment of FIG. 1 including the cutters of FIGS. 5, 6 and 7.

In FIG. 8, there is shown an end view of the cutter section 36 showing the cutter blades 40A, 40B and 40C spaced along the cutter section to receive a rail beam at the three points 76 on the three cutters. At these points, the force of the impact of the vehicle causes cutting of the W-beam or other rail member to dissipate energy. The plates 70 and 72 shown in FIG. 7 are located with respect to each other and to adjacent cutters to cause the severed sections of the beam to be deflected in opposite directions. This is done by alternating the location of the plate 72 with respect to the plate 70 with respect to adjacent cutters 40A, 40B and 40C so that the plate 72 is on the top side of the plate 70 for the top cutter 40A to deflect the severed portion of the beam upwardly, the plate 72 is on the bottom side of the plate 70 for the cutter 40B adjacent to the cutter 40A to deflect the severed portion of the beam downwardly and so on.

While three cutters are shown in FIG. 8, any other number may be selected and the spacing between them may be varied to change the amount of energy absorbed.

Similarly, the energy absorbed depends on the thickness and structure of the beam being cut and the shape and thickness of the cutter. The number of cuts changes the amount of energy absorbed in bending the beam to reduce that energy but increases the energy absorbed in cutting the beam because of the added points of cutting. The amount of energy selected for absorption depends upon the momentum of the vehicles that are expected to impact the terminal and the amount of de-acceleration desired.

Figure 9:
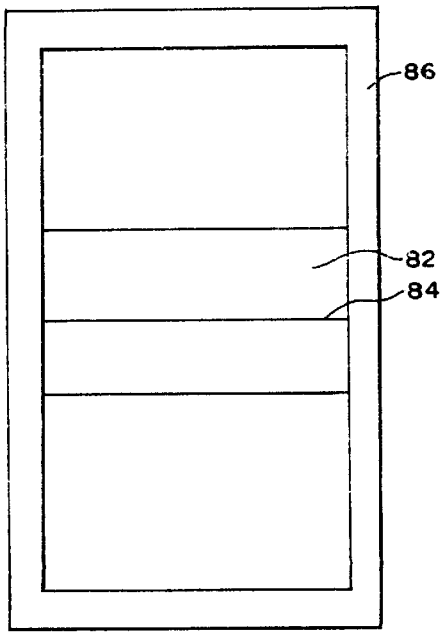
FIG. 9 is an end view of another embodiment of cutting section which may be utilized under some circumstances instead of the embodiment of FIG. 8.

In FIG. 9, there is shown another cutting section 36A having a single steel wedge 82 having a forward pointed edge 84 welded to the sides of the steel open frame 86 of the cutting section. With this embodiment, the bending loss is much greater and the cutting energy absorbed is related to the angle of the sides of the wedge in the cutting location of the beam. It may be most useful for unusually strong metal beams or beams of non-ductile material or brittle material such as fiber reinforced plastic.

Figure 10:
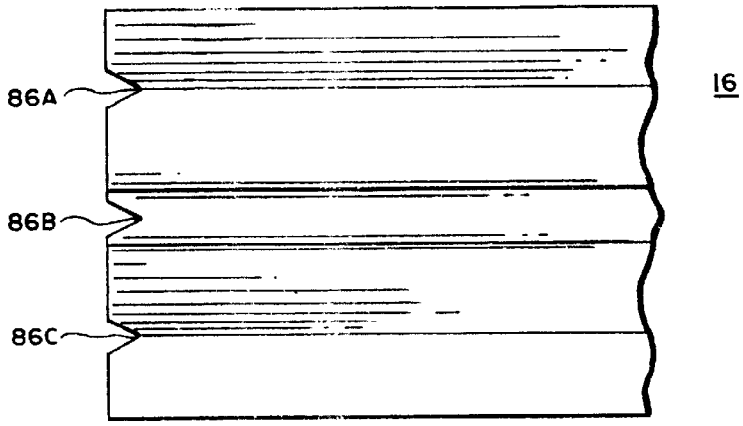
FIG. 10 is an embodiment of guardrail showing a W-beam, the end of which is cut to accommodate the cutting blades of FIG. 8.

In FIG. 10, there is shown a fragmentary view of a W-beam 16 having three V-shaped cuts 86A, 86B and 86C positioned to be aligned with the cutter blades 40A, 40B and 40C to cut the W-beam 16 at locations which form sections with low moments of inertia. In the case of a W-beam, the cuts are made at locations which reduce the overall curvature to reduce the moments of inertia and thus the force needed to bend the W-beam. Other shaped beams may be cut at different points and the energy of absorption may also be changed by changing the location of the cuts so as to increase or decrease the moments of inertia of the segments being bent aside by the deflector plate 64 (FIG. 6). For very high moments of inertia sections, the strength of the deflector plate may need to be increased. The notches are not necessary for the operation of the invention but are made for convenience in locating the cutter blades. The shape and location of the deflector plate affects the amount of energy absorbed and may be modified to increase or decrease the energy absorption per linear foot of travel of the impact head.

Figure 11:
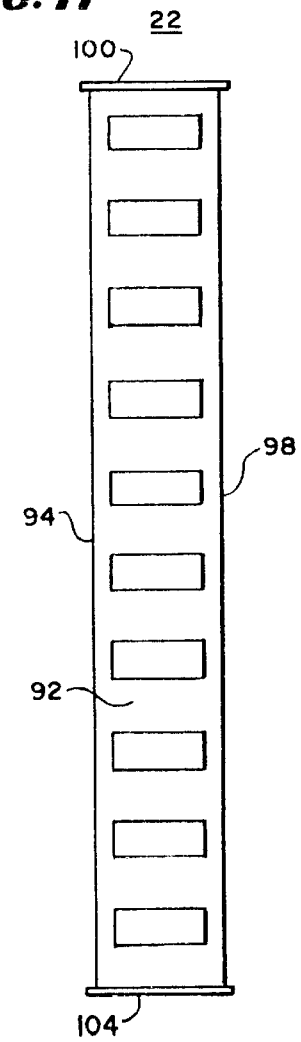
FIG. 11 is a front view of an anchor in accordance with an embodiment of the invention.
Figure 12:
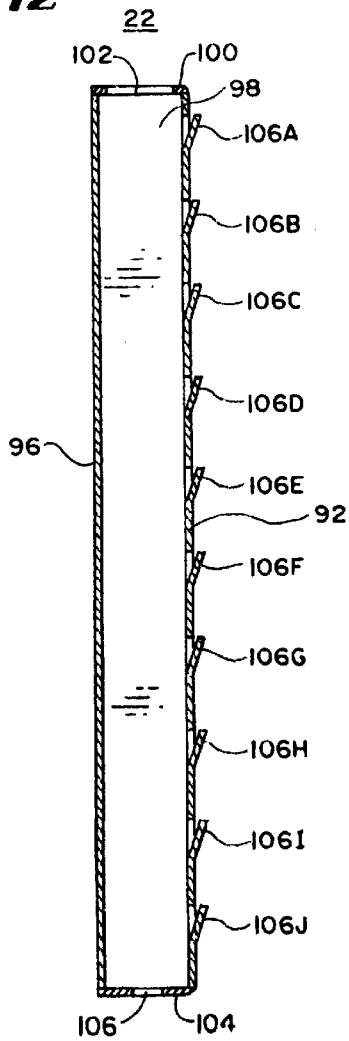
FIG. 12 is an elevational sectional view of the anchor of FIG. 11.

In FIGS. 11 and 12, there is shown a front elevational view and a side sectional view of the anchor 22 respectively having a front side 92, left side 94 (FIG. 11), a back side 96 and a right side 98, each being elongated to form a parallelopiped member that is 24 and 15/16th inches long and three and one/half inches wide and two and one/half inches deep. A first rectangular end member 100 contains a relatively large diameter opening 102 to receive a cable 26 (FIG. 1) and a second rectangular end member 104 includes a narrower opening 106 so as to permit the cable 26 to pass through and be fastened on the outside of the anchor 22. With this arrangement, the cable 26 (FIG. 1) extends through the anchor 22 and is fastened at one end thereof. On the front surface 92 are a plurality of raised portions 106A–106J which are sized to receive the tabs 50 bent outwardly from the W-beam 16 (FIG. 3) to permit the anchor 22 to be removably mounted to the W-beam 16 and to hold the cable 26 by means of the retention member or bolt 46 (FIG. 4).

In FIG. 13, there is shown a fragmentary, elevational view of the section of the W-beam 16 showing the manner in which the tabs 50A–50J that engage the cut portions 106A–106J (FIG. 12) of the anchor 22 form a connection between the rail 16 and the anchor 22. This mechanism is designed for easy connection and easy release when the post 14A (FIG. 1) is broken to release tension between the cable 26 and the anchor 22 holding the tabs within the anchor.

In FIG. 14, there is shown another embodiment of guardrail 10A serving to protect vehicles from hard structures 120 such as an overpass or the like. In this embodiment, the terminal assembly 18 is constructed in the same manner as in the embodiment of FIG. 1 although instead of a W-beam, a structural pipe may be used to cooperate with the terminal to absorb energy in the event a vehicle hits the terminal. In this embodiment, beam 130 is horizontally mounted between two parallel rails 122 and 124, each having corresponding overlapping guardrail sections 122A–122D and 124A–124C, supported by corresponding ones of the breakaway posts 126A–126D. The structure without the terminal assembly 18 and beam 130 is similar in operation and construction as that described in the aforementioned U.S. Pat. No. 4,655,434.

In this embodiment, the terminal assembly 18 operates as an energy absorbing terminal together with the energy absorbing nature of the overlapping rail sections and breakaway posts to control a vehicle and avoid its hitting the hard structure 120.

Figure 15:
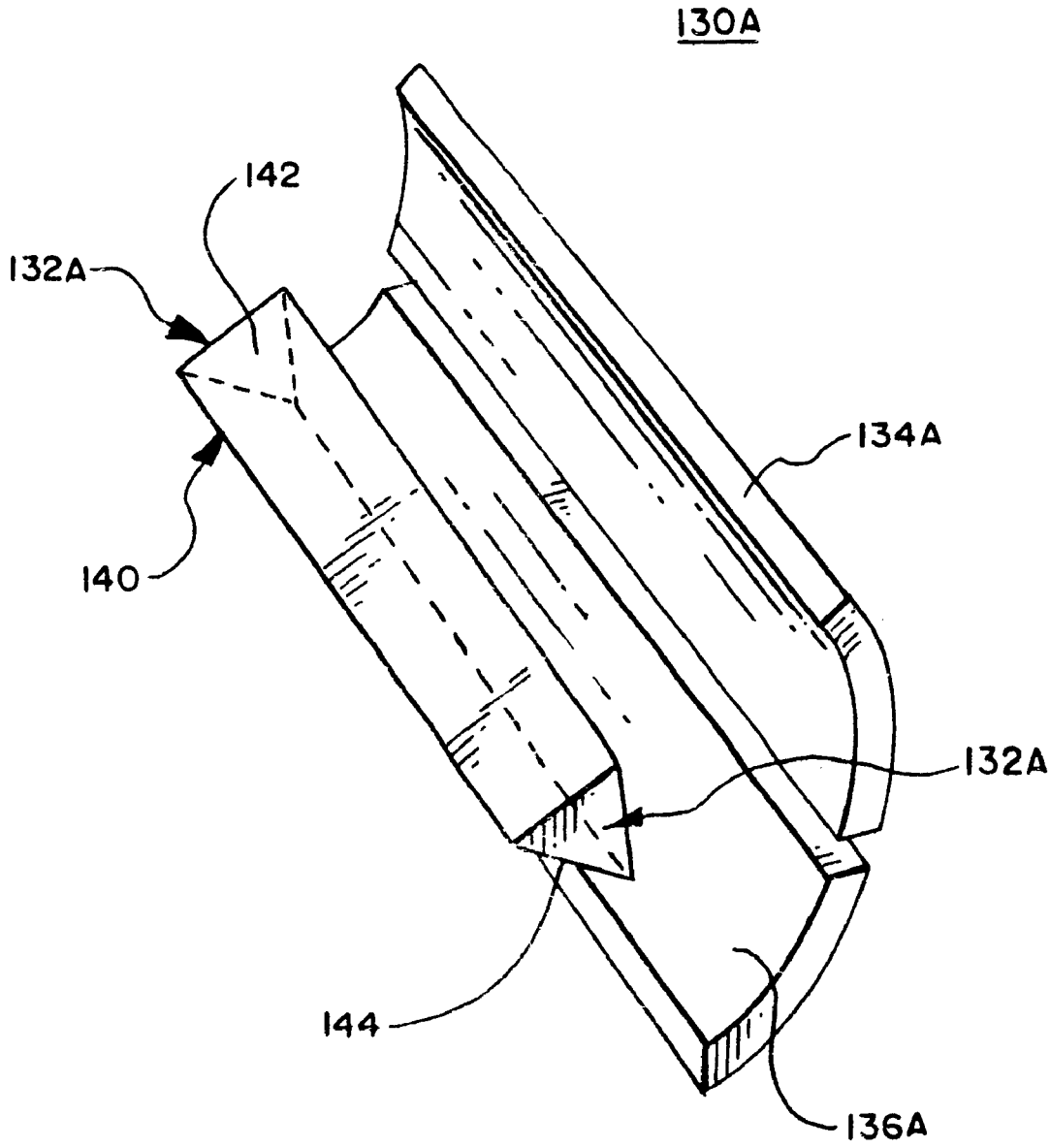
FIG. 15 is a simplified perspective view of a cutting wedge and deflector plate that may be used in the embodiment of FIG. 9.

In FIG. 15, there is shown a simplified embodiment 130A of a cutter of the type shown in FIG. 9 adapted for receiving a guardrail of fiber reinforced plastic having a cutting edge 140 adapted to receive a beam and two adjacent cutting sides 142 and 144 to split the rail. The fail fragments are deflected in opposite directions and fragmented by the deflector plates 134A and 136A which tend to bend them away from the cutting edge 140, causing fracturing of the brittle material by breaking in tension, cracking in compression and buckling. The amount of energy absorbed is determined by the size and angle of the cutting edge 140 and sides 142 and 144 and by the position and shape of the deflector plates 134A and 136A.

As can be understood from the above description, a terminal may be fabricated to provide a selected amount of energy absorption per linear foot of movement of the impact head by a vehicle by selecting the number of cutters, the shape of the cutters and the location of the cutting with respect to the thickness and strength of the guardrail member and the nature of the deflecting plate that bends the guardrail. This selection may be made to accommodate different maximum and minimum speeds on a highway and the type of vehicles that are most likely to result in bodily injury in the event that they tend to leave the roadway.

In operation, the terminals are mounted at the end of the guardrail without the need for flaring the guardrail away from the roadway. When the vehicle hits the terminal, the terminal and rail are moved with respect to each other while cutters cut the rail and a deflection plate bends it so as to absorb energy and slow the vehicle down. If the vehicle hits the guardrail itself, a tension member holds the guardrail to restrain and redirect the vehicle. This cable anchor retention member is released when a vehicle hits the terminal to avoid the connection between the terminal and the rail member from causing unintended damage to persons in the vehicle.

From the above description, it can be understood that the guardrail of this invention has several advantages, such as for example: (1) it is economical to construct; and (2) it provides greater versatility and selection of the energy-absorbing cutters to accommodate different circumstances and different types of rails.

Although a preferred embodiment of the invention has been described with particularity, many modifications and variations in the invention may be made without deviating from the invention. Therefore, it can be understood that, within the scope of the appended claims, the invention may be practiced other than described.

What is claimed is:

1. A guardrail terminal adapted to cooperate with a guardrail comprising:

an impact head; and a cutting section being mounted for movement with said impact head, said cutting section including:

means for cutting the guardrail when the guardrail terminal and the guardrail are moved with respect to each other;

a cutter holding section for holding said means for cutting; and a hollow receiving section sized and shaped to receive the guardrail;

said cutter section and hollow receiving section being positioned with respect to each other to guide the guardrail as said terminal and guardrail are moved together.

2. A guardrail terminal according to claim 1 in which the means for cutting includes a plurality of cutters selected in accordance with the amount of energy intended to be absorbed upon impact with vehicles expected to impact the guardrail terminal.

3. An energy-absorption system for positioning along a roadway to absorb the energy of an errant vehicle, the energy-absorption system comprising:

an impact head;

an angled cutter; and an elongated cuttable member horizontally mounted between two parallel guardrails;

wherein the energy-absorption system is positionable along a roadway to cooperate with the upstream portion of a roadside hazard; and wherein the impact head is in operational connection with the cutter and the cuttable member such that the impact of an errant vehicle with the impact head will cause the cutter to cut at least a portion of the cuttable member to absorb the impact energy of the errant vehicle.

4. The energy-absorption system of claim 3 wherein each of the two parallel guardrails is constructed of overlapping guardrail sections.

5. The energy-absorption system of claim 4 wherein at least one of the two parallel guardrails is supported by at least one corresponding break-away post.

6. The energy-absorption system of claim 4 further including:

a deflector positioned to bend at least a portion of the cuttable member away from the path of the current vehicle.

7. The energy-absorption system of claim 4 wherein the cuttable member is a structural pipe.

8. The energy-absorption system of claim 3 wherein at least one of the two parallel guardrails is supported by at least one corresponding break-away post.

9. The energy-absorption system of claim 3 further including:

a deflector positioned to bend at least a portion of the cuttable member away from the path of the errant vehicle.

10. The energy-absorption system of claim 3 wherein the cuttable member is a structural pipe.

11. The energy-absorption system of claim 3 wherein the angled cutter comprises a cutter that is positioned such that at least one edge of the cutter approaches the cuttable member at an acute angle.

12. The energy-absorption system of claim 11 wherein the angled cutter comprises two plates that form an acute angle where the edges of the two plates cross at a point.

13. The energy-absorption system of claim 11 wherein the angled cutter comprises a wedge having a forward pointed edge.

14. An energy-absorption system for positioning along a roadway to absorb the energy of an errant vehicle, the energy-absorption system comprising:

an impact head;

an angled cutter;

two parallel guardrails, each of which is constructed of overlapping guardrail sections; and an elongated cuttable member mounted horizontally between the two parallel guardrails;

wherein the energy-absorption system is positionable along a roadway to cooperate with the upstream portion of a roadside hazard; and wherein the impact head is in operational connection with the cutter and the cuttable member such that the impact of an errant vehicle with the impact head will cause the cutter to cut at least a portion of the cuttable member to absorb the impact energy of the errant vehicle.

15. The energy-absorption system of claim 14 wherein at least one of the two parallel guardrails is supported by at least one corresponding break-away post.

16. The energy-absorption system of claim 14 further imcluding:

a deflector positioned to bend at least a portion of the cuttable member away from the path of the errant vehicle.

17. The energy-absorption system of claim 14 wherein the cuttable member is a structural pipe.

18. An energy-absorption system for positioning along a roadway to absorb the energy of an errant vehicle, the energy-absorption system comprising:

an impact head;

an angled cutter;

two parallel guardrails, each of which is constructed of overlapping guardrail sections;

at least one break-away post supporting at least one of the two parallel guardrails;

an elongated cuttable member formed of a structural pipe mounted horizontally between the two parallel guardrails;

wherein the energy-absorption system is positionable along a roadway to cooperate with the upstream portion of a roadside hazard; and wherein the impact head is in operational connection with the cutter and the cuttable member such that the impact of an errant vehicle with the impact head will cause the cutter to cut at least a portion of the cuttable member to absorb the impact energy of the errant vehicle; and a deflector positioned to bend at least a portion of the cuttable member away from the path of the errant vehicle.

* * * * *